US006449994B1

(12) United States Patent
Kreyenborg

(10) Patent No.: US 6,449,994 B1
(45) Date of Patent: Sep. 17, 2002

(54) DOORLOCK FOR AN ALL-GLASS DOOR WITH FIXED GLASS SIDE PANEL

(75) Inventor: Ralf Kreyenborg, Bad Salzuflen (DE)

(73) Assignee: Dorma GmbH & Co. KG, Ennepetal (DE)

( * ) Notice: Subject to any disclaimer, the term of this patent is extended or adjusted under 35 U.S.C. 154(b) by 0 days.

(21) Appl. No.: 09/557,442

(22) Filed: Apr. 25, 2000

Related U.S. Application Data

(63) Continuation-in-part of application No. PCT/EP99/06250, filed on Aug. 26, 1999.

(30) Foreign Application Priority Data

Aug. 26, 1998 (DE) ..... 198 38 623

(51) Int. Cl.[7] ..... E05B 65/08; E05B 63/14; E05C 1/04

(52) U.S. Cl. ..... 70/101; 70/102; 70/107; 292/253

(58) Field of Search ..... 70/101, 102, 107, 70/100, 131, 81, 90; 292/253, 36, 278, 337, DIG. 46, DIG. 53

(56) References Cited

U.S. PATENT DOCUMENTS

| | | | | | |
|---|---|---|---|---|---|
| 2,402,753 | A | | 6/1946 | Jones | 70/135 |
| 2,952,150 | A | | 9/1960 | Matzkin et al. | 70/451 |
| 3,670,537 | A | * | 6/1972 | Horgan, Jr. | 70/120 |
| 3,938,836 | A | * | 2/1976 | Smith | 292/148 |
| 3,956,911 | A | * | 5/1976 | Corboud | 70/100 |
| 4,125,022 | A | * | 11/1978 | Bara Marco | 70/102 |
| 4,456,290 | A | * | 6/1984 | Gross et al. | 292/337 |
| 5,015,022 | A | * | 5/1991 | McGuire | 292/278 |
| 5,595,409 | A | * | 1/1997 | Fier et al. | 292/112 |
| 5,765,410 | A | * | 6/1998 | Kwan et al. | 70/107 |
| 6,042,161 | A | * | 3/2000 | Mantarakis et al. | 292/253 |

FOREIGN PATENT DOCUMENTS

| | | |
|---|---|---|
| DE | 7328782 | 3/1974 |
| DE | 7634506 | 2/1977 |
| DE | 4300810 | 7/1994 |
| DE | 4400196 | 6/1995 |
| GB | 892698 | 3/1962 |
| WO | 9521981 | 8/1995 |

* cited by examiner

*Primary Examiner*—Tan Nguyen
*Assistant Examiner*—Dalena Tran
(74) *Attorney, Agent, or Firm*—Nils H. Ljungman & Associates

(57) ABSTRACT

A door lock for an all-glass door with an adjacent fixed glass side panel. In this case, the door lock is attached through a boring contained in the all-glass door and basically presents a dead bolt, a latch bolt and a follower. Furthermore, a lock strike box is mounted through a boring contained in the glass side panel at the height of the door lock. Furthermore, the door lock comprises a first lock casing arranged on one side of the all-glass door and a second lock casing placed opposite to the first lock casing on the other side of the all-glass door. The first lock casing comprises the latch bolt and the second lock casing comprises the strike plate for the dead bolt. Furthermore, there are a first lock strike box and a second lock strike box, effectively connected to each other by means of a closing cylinder through a boring contained in the fixed glass side panel. The dead bolt is supported ready for locking action in the second lock strike box, whereby a catch for the latch bolt is contained in the first lock strike box.

20 Claims, 4 Drawing Sheets

DOORLOCK FOR AN ALL-GLASS DOOR WITH FIXED GLASS SIDE PANEL

CONTINUING APPLICATION DATA

This application is a Continuation-In-Part application of International Patent Application No. PCT/EP99/06250, filed on Aug. 26, 1999, which claims priority from Federal Republic of Germany Patent Application No. 198 38 623.0, filed on Aug. 26, 1998. International Application No. PCT/EP99/06250 was pending as of the filing date of the above-cited application. The United States was an elected state in International Application No. PCT/EP99/06250.

BACKGROUND OF THE INVENTION

1. Field of the Invention

The present invention relates to a door lock for an all-glass installation which comprises a fixed glass side panel, whereby the door lock is attached to the all-glass door through a boring contained therein, and basically includes a dead bolt, a latch bolt and a follower. A lock strike box is attached to the glass side panel through a boring contained therein at the height of the door lock, the door lock being designed to include a first and a second lock casing as well as a first and a second lock strike box, which in each case only one of them comprises respectively is engaged by, the latch bolt respectively the dead bolt. In other words, the latch bolt corresponds to and is engaged with one of the first and second lock casing and one of the first and second lock strike box, while the dead bolt corresponds to and is engaged with the other one of the first and second lock casing and the other one of the first and second lock strike box.

2. Background Information

Door locks for all-glass doors are known in the art, which locks preferably comprise only one latch bolt to be blocked for example, through actuation of a key. In this case, the portion of the door lock that is actuated via a follower by means of a lever handle and comprises the latch bolt, is mounted on the all-glass door leaf, and the lock strike box provided at the fixed side panel comprises a strike plate for the latch bolt.

From German Patent No. 43 00 810 A1 and German Utility Model No. 76 34 506, door locks for all-glass installations are known which are equipped with only one closing mechanism in the form of a catch bolt or a dead bolt. With regard to current safety requirements, this simply behaving closing possibility is to be considered as non-satisfactory.

German Patent No. 44 00 196 C1 and German Utility Model No. 73 28 782 illustrate door locks for all-glass installations realized with one latch bolt and one dead bolt mechanism. Due to realization of both closing mechanisms, the design of these locks is large in size. Under aesthetic aspects, it is not really advantageous to utilize such a large construction type in all-glass installations. Moreover, these locks can not be universally mounted to a door and to a fixed side panel.

OBJECT OF THE INVENTION

The object of the present invention is a further development of a door lock of the known art, which can be universally utilized and can be used for different purposes after minor modification. Furthermore, such type of door lock should be substantially easy to install.

SUMMARY OF THE INVENTION

The object of the invention is realized in a door lock, which door lock presents a first lock casing, which is arranged on one side of the all-glass door, and a second lock casing which is placed opposite to the first lock casing on the other side of the all-glass door. The latch bolt can be included in the first lock casing and the strike plate for a dead bolt can be included in the second lock casing. The door lock can comprise a first lock strike box and a second lock strike box, which are effectively connected to each other by means of a closing cylinder through a boring contained in the fixed side panel, whereby the dead bolt ready for locking action is supported in the lock strike box and the lock strike box contains a catch for the latch bolt. The additional features shown herein reflect further developments of the inventive idea. A door lock of the known art is therefore further developed in that both the lock casing as well as the lock strike box is separated. This means each side of the all-glass installation comprises respectively one lock casing and one lock strike box. In this case, the lock casings are linked to each other through a boring contained in the all-glass door and by means of a lever spindle passing through this boring and linking both lever handles to each other respectively on the all-glass door front and rear face. Likewise, the lock strike boxes are attached, however, in this case, by means of a connector passing through a boring in the fixed side panel at the height of and in alignment with the lock casings. A closing cylinder is inserted through the boring inside the fixed glass side panel and by the way or in this manner effectively connects both lock strike boxes to each other.

The lock casings and the lock strike boxes are designed such that, when respectively seen against each other, that is to say, from one first side to the other second side, they are substantially identically designed as to their geometrical dimensions. For this reason only two moulds are essentially required.

The latch bolt of the door lock can be comprised and/or contained in a first lock casing that is mounted on the side of the all-glass door to which the connected all-glass door opens via a hinge in a rotation point. One part of the lock casing protrudes past the vertical edge of the all-glass door. This protruding part contains the door lock's latch bolt. The second lock casing provided on the opposite side of the all-glass door presents a recess with regard to the aforementioned vertical edge of the all-glass door. A strike plate with aperture can be arranged in this recess, into which aperture engages a dead bolt comprised in a lock strike box of the side panel. This opposite lock strike box also protrudes past the vertical edge of the fixed glass side panel, such that, in this protruding part, upon locking action by means of the closing cylinder, the dead bolt moves forward and engages in the strike plate of the second lock casing. On the opposite side of this lock strike box of the fixed all-glass side panel can be arranged on the other side a lock strike box having the same shape as the lock casing, which comprises the strike plate for the dead bolt. This lock strike box also recesses at its outer edge with regard to the edge of the vertical all-glass side panel, such that the protruding part of the first lock casing with the therein contained latch bolt partially overlaps the lock strike box. The latch bolt of the first lock casing can thereby engage into an aperture of the lock strike box arranged on the opposite side.

The above discussed embodiments of the present invention will be described further hereinbelow with reference to the accompanying figures. When the word "invention" is used in this specification, the word "invention includes" "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The present invention is described on the basis of at least one possible diagrammatically illustrated embodiment example in the following figures. It shows.

DESCRIPTION OF THE PREFERRED EMBODIMENT

Figure 1:
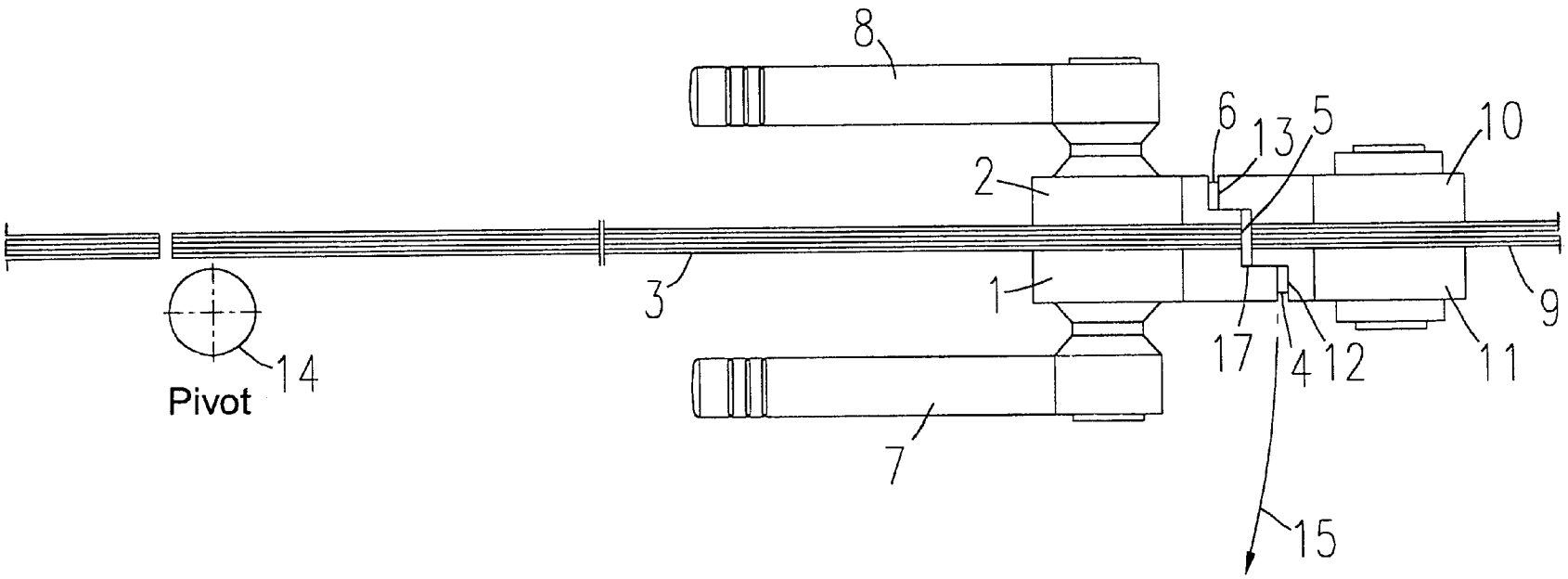
FIG. 1 a sectional view through an all-glass door with fixed side panel including the door lock.

The all-glass door 3 including an adjacent fixed glass side panel 9 illustrated in FIG. 1 may be for example components of an installation. In this case, the all-glass door 3 is pivotably supported in a rotation-point 14 by means of non-illustrated hinges. On the side of the all-glass door 3, the door lock basically comprises a first lock casing 1 and a second lock casing 2. The lock casings 1 and 2 are solidly positively and non-positively connected with the all-glass door 3 by means of non-illustrated connectors. A lever spindle passes through a boring contained in the all-glass door 3 and extends at the same time through the non-illustrated follower. The lever handles 7 and 8 are mounted to the lever spindle ends.

At the fixed glass side panel 9 arranged in true alignment with the all-glass door 3, the lock strike boxes 10 and 11 are solidly positively and non-positively mounted to the fixed glass side panel 9 likewise by means of non-illustrated attachments. A closing cylinder 16 (FIG. 2) passes through another boring contained in the glass side panel 9. The dead bolt 6 contained in the lock strike box 10 is actuated by means of a non-illustrated closing nose of the closing cylinder 16. In this case, the dead bolt 6 moves out of a protruding projection 13 of lock strike box 10 with regard to a vertical edge 17 of the fixed glass side panel 9. The lock strike box 11 is designed such to comprise a recess 12 with regard to the vertical edge 17 of the fixed glass side panel 9. An opening into which a latch bolt 4 can engage is provided within the recess 12. In this case, the latch bolt 4 is displaceably arranged in the lock casing 1. The lock casing 1 protrudes with regard to a vertical edge 5 of the all-glass door 3 and thus covers, respectively overlaps the recess of the lock strike box 11. Likewise, the lock casing 2 presents a recess, which is formed analogous to the recess 12 of the lock strike box 11, as the geometrical dimensions of the parts are identical.

Figure 2:
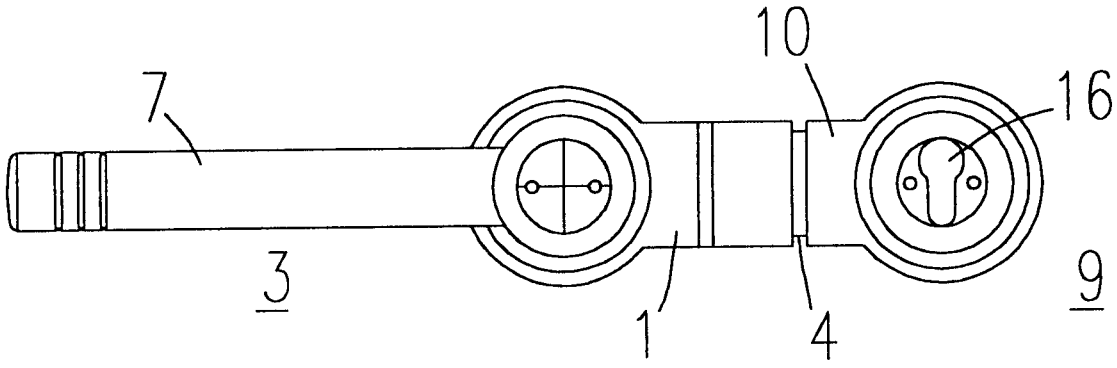
FIG. 2 a front view of a door lock with all-glass door and fixed side panel.

Upon actuation of the lever handle 7 or 8, the latch bolt 4 is retracted into the lock casing 1 and in case the dead bolt 6 is not moved forward, the all-glass door 3 can be pivoted in an opening direction 15. The all-glass door 3 is analogously closed, in the opposite way. Upon the actuation of closing cylinder 16, which is illustrated in FIG. 2, the dead bolt 6 moves forward out of the lock casing 2. In such case, the all-glass door 3 is locked, so that the all-glass door 3 can not be opened upon actuation of the lever handles 7, 8.

Figure 3:
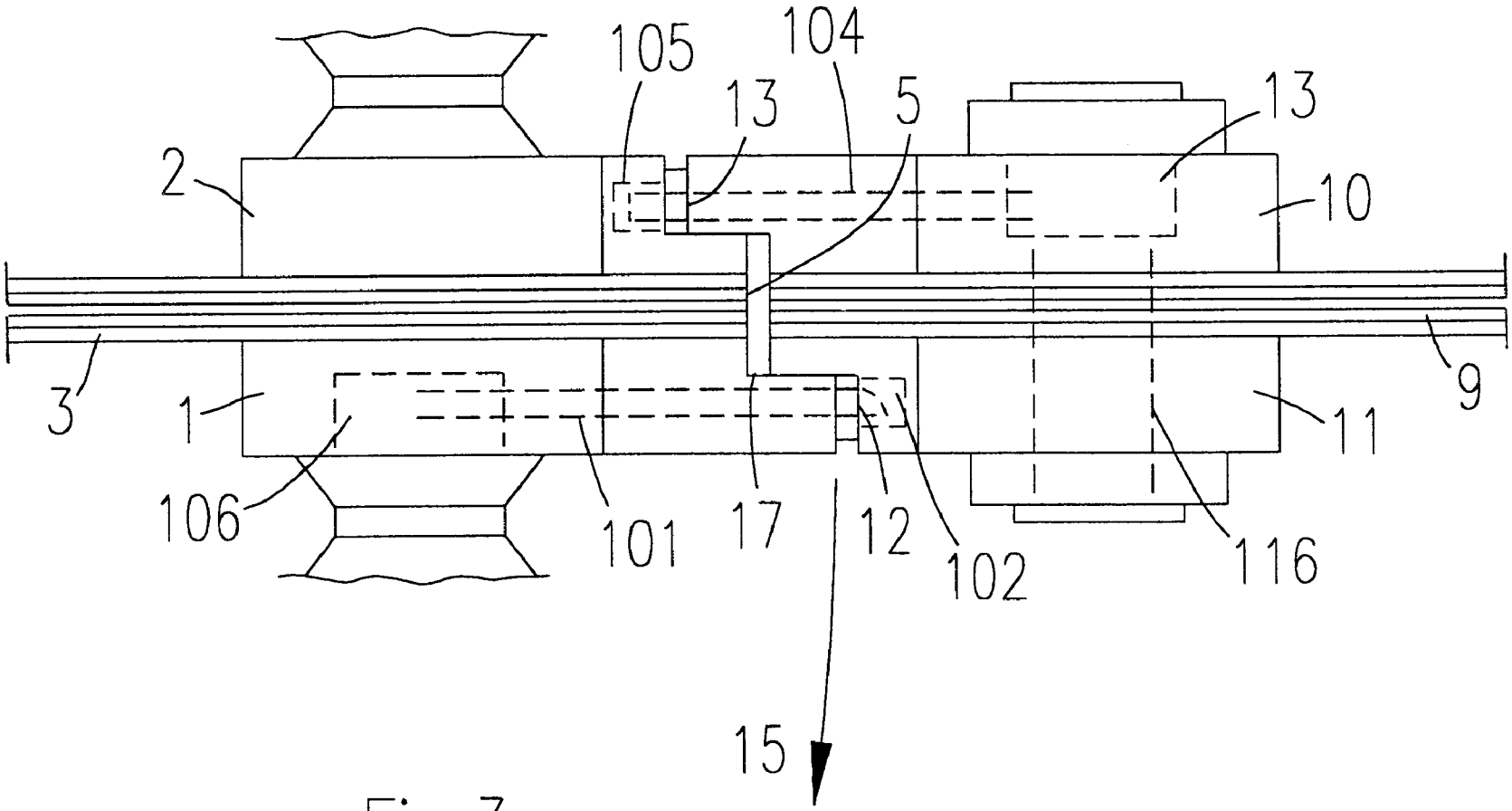
FIG. 3 a second section view according to at least one embodiment of the present invention showing the interior mechanisms in dashed lines.

FIG. 3 shows a sectional view through the components of the installation. A latch bolt mechanism 106 located in lock casing 1 is shown connected to a latch bolt 104. The latch bolt mechanism 106 is connected to a handle lever or other actuation means to permit actuation of the latch bolt mechansim 106 to move the latch bolt 101 into a hole 102. The hole 102 for receiving the latch bolt 101 is located in lock strike box 11. Further, FIG. 3 shows a dead bolt mechanism 103 located in the lock strike box 10, which dead bolt mechanism 103 is connected to a dead bolt 104 to move the dead bolt 104 into a hole 105 to permit locking of the door arrangement. The dead bolt mechanism 103 is operatively connected to and can be actuated by a closing cylinder or key mechanism 116 which is located in a boring in the glass side panel 9. The hole 105 for receiving the dead bolt 104 can be located in lock casing 2.

Figure 4:
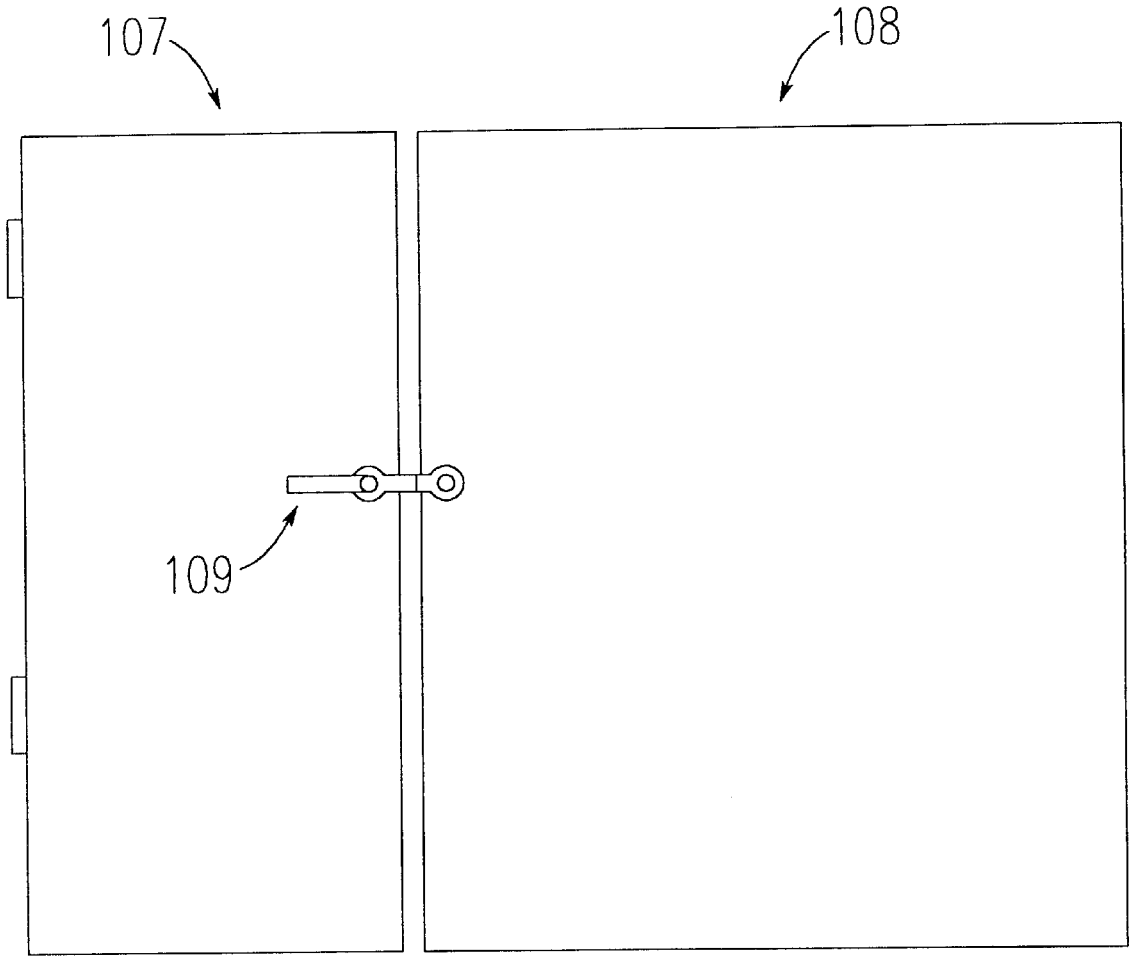
FIG. 4 a view of an all-glass door and adjacent fixed side panel according to at least one embodiment of the present invention.

FIG. 4 shows a door arrangement having an all-glass door 107 and an adjacent fixed glass side panel 108 according to at least one embodiment of the present invention. The door arrangement also has a locking arrangement 109 similar to the one shown in FIG. 2.

One feature of the invention resides broadly in the door lock for an all-glass door comprising a fixed glass side panel, whereby the door lock is attached through a boring contained in the all-glass door and basically includes a dead bolt, a latch bolt and a follower, which is penetrated by a lever spindle, which free ends engage in the lever necks, and a lock strike box is fixed via a boring contained in the glass side panel at the height of the door lock, characterized in that the door lock presents a first lock casing 1, which is arranged on one side of the all-glass door 3, and a second lock casing 2 which is placed opposite to the first lock casing 1 on the other side of the all-glass door 3, whereby the latch bolt is included in lock casing 1 and the strike plate for a dead bolt 6 is included in lock casing 2, and comprises a first lock strike box 11 and a second lock strike box 10, which are effectively connected to each other by means of a closing cylinder 16 through a boring contained in the fixed side panel 9, whereby the dead bolt 6 ready for locking action is supported in the lock strike box 10 and the lock strike box 11 contains a catch for the latch bolt 4.

Another feature of the invention resides broadly in the door lock for an all-glass door characterized in that the lock casing 1 protrudes the vertical edge 5 of the all-glass door 3 and the latch bolt 4 is arranged in the protruding part.

Yet another feature of the invention resides broadly in the door lock for an all-glass door characterized in that, with regard to the vertical edge 5 of the all-glass door 3, the lock casing 2 contains a recess in the area of the strike plate for the dead bolt 6.

Still another feature of the invention resides broadly in the door lock for an all-glass door characterized in that dead bolt 6 in the lock strike box 10 moves forward out of a projection 13 protruding with regard to a vertical edge of the fixed glass side panel 9.

A further feature of the invention resides broadly in the door lock for an all-glass door characterized in that lock strike box 10 presents a recess 12 with regard to a vertical edge 17 of the fixed glass side panel 9.

Another feature of the invention resides broadly in the door lock for an all-glass door characterized in that the lock casing 1 and the lock strike box 10 present the same geometrical dimensions.

Yet another feature of the invention resides broadly in the door lock for an all-glass door characterized in that the lock casing 2 and the lock strike box 11 present the same geometrical dimensions.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The patents, patent applications, and/or patent publications, cited in the International Search Report dated Dec. 15, 1999, and elsehwere, are hereby incorporated by reference as if set forth in their entirety herein as follows: U.S. Pat. No. 2,952,150, issued to inventors Matzkin, et al. on Sep. 13, 1960; International Patent Publication No. WO 95/21981 A, issued to Societá Italiana Progetti S.R.L. on Aug. 17, 1995 and International Patent Application No. PCT/EP95/00550 having international filing date Feb. 15, 1995; Great Britain Patent No. 892 698 A, issued to inventor Smith on Mar. 28, 1962; U.S. Pat. No. 2,402,753 A issued to inventor Jones on Jun. 25, 1946; Federal Republic of Germany Patent Application DE 43 00 810 A1, filed on Jan. 14, 1993; Federal Republic of Germany Patent DE 44 00 196 C1, issued on Jun. 29, 1995; Federal Republic of Germany Utility Model No. 76 34 506, dated Feb. 24, 1977; and Federal Republic of Germany Utility Model No. 73 28 782, dated Mar. 21, 1974.

The corresponding foreign and international patent publication applications, namely, Federal Republic of Germany Patent Application No. 198 38 623.0, filed on Aug. 26, 1998, having inventor Ralf Kreyenborg, and DE-OS 198 38 623.0 and DE-PS 198 38 623.0 and International Application No. PCT/EP99/06250, filed on Aug. 26, 1999, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

AT LEAST PARTIAL NOMENCLATURE

1. Lock casing
2. Lock casing
3. All-glass door
4. Latch bolt
5. Vertical edge
6. Dead bolt
7. Lever handle
8. Lever handle
9. Fixed glass side panel
10. Lock strike box
11. Lock strike box
12. Recess
13. Projection
14. Rotation point
15. Opening direction
16. Closing cylinder
17. Vertical edge

What is claimed is:

1. In an all-glass door assembly, a door locking assembly to secure a moveable hinged glass door to a stationary door member, said door locking assembly comprising:

a latch assembly to latch a glass door in a closed position;

said latch assembly being configured to be connected to a glass door;

a dead bolt assembly to lock a glass door in a locked position;

said dead bolt assembly being configured to be connected to a glass side panel disposed adjacent to a glass door;

said dead bolt assembly comprising a dead bolt to lock a glass door;

said latch assembly comprising means for receiving and holding said dead bolt to thus lock a glass door;

said latch assembly comprising a latch member for latching and unlatching a glass door;

said latch assembly comprising means for operating said latch member to latch and unlatch a glass door;

said dead bolt assembly comprising means for receiving and holding said latch member to latch the door.

2. The door locking assembly according to claim 1, wherein:

one of said latch assembly and said dead bolt assembly comprises a protruding portion; and said protruding portion is configured to stop the pivoting movement of a glass door.

3. The door locking assembly according to claim 2, wherein:

said latch assembly comprises:

a first portion configured to be disposed on a first side of a glass door;

a second portion configured to be disposed on a second side of a glass door opposite said first portion of said latch assembly;

said dead bolt assembly comprises:

a first portion configured to be disposed on a first side of a glass side panel; and a second portion configured to be disposed on a second side of a glass side panel opposite said first portion of said dead bolt assembly;

said first portion of said latch assembly and said first portion of said dead bolt assembly together form a first structure;

said second portion of said latch assembly and said second portion of said dead bolt assembly together form a second structure; and said first structure is configured to have substantially equal vertical and horizontal dimensions as said second structure to obscure a view of said second structure upon looking at said first structure from the first side of a glass door and a glass side panel, and to obscure a view of said first structure upon looking at said second structure from the second side of a glass door and a glass side panel.

4. The door locking assembly according to claim 3, wherein said means for receiving and holding said latch member comprises a recess configured to receive and hold said latch member.

5. The door locking assembly according to claim 4, wherein said means for receiving and holding said dead bolt comprises a hole configured to receive and hold said dead bolt.

6. The door locking assembly according to claim 5, wherein said means for operating said latch member to latch and unlatch a glass door comprises:

a shaft configured to be rotated to operatively move said latch member;

said shaft is configured be disposed through a hole in a glass door to extend from both sides of said glass door;

a first extending portion connected to one end of said shaft and a second extending portion connected to the opposite end of said shaft;

each of said first and second extending portions extends a substantial distance out and away from said shaft and is configured to be grasped and moved by a user to rotate said shaft; and each of said first and second extending portions are substantially the same size and configured to be disposed such that a view of said first extending portion is substantially obscured upon looking at said second extending portion from one side of a glass panel, and such that a view of said second extending portion is substantially obscured upon looking at said first extending portion from an opposite side of a glass panel.

7. The door locking assembly according to claim 6, wherein said first and second extending portions each comprise handles;

each of said latch assembly and said dead bolt assembly comprises said protruding portion;

said protruding portion of said latch assembly is configured to protrude beyond a vertical edge of a glass door adjacent a glass side panel;

said protruding portion of said dead bolt assembly is configured to protrude beyond a vertical edge of a glass side panel adjacent a glass door;

said latch member is disposed in said protruding portion of said latch assembly; and said dead bolt is disposed in said protruding portion of said dead bolt assembly and configured to extend out of said protruding portion of said dead bolt assembly.

8. The door locking assembly according to claim 7, wherein:

said dead bolt assembly comprises a lock cylinder operatively connected to said dead bolt; and said lock cylinder is configured to be actuated to move said dead bolt into and out of said hole.

9. A door locking assembly to secure a moveable hinged glass door to a stationary door member, said door locking assembly comprising:

a latch assembly;

said latch assembly being configured to be connected to a glass door;

a dead bolt assembly;

said dead bolt assembly being configured to be connected to a stationary door member disposed adjacent to glass door;

said dead bolt assembly comprising a dead bolt;

said latch assembly comprising means for receiving and holding said dead bolt;

said latch assembly comprising a latch member for latching a door; and said dead bolt assembly comprising means for receiving and holding said latch member to latch the door.

10. The door locking assembly according to claim 9, wherein said means for receiving and holding said latch member comprises a recess configured to receive and hold said latch member.

11. The door locking assembly according to claim 10, wherein said means for receiving and holding said dead bolt comprises a hole configured to receive and hold said dead bolt.

12. The door locking assembly according to claim 11, wherein:

one of said latch assembly and said dead bolt assembly comprises a protruding portion; and said protruding portion is configured to stop the pivoting movement of a glass door.

13. The door locking assembly according to claim 12, wherein:

said latch assembly comprises:

a first portion configured to be disposed on a first side of a glass door;

a second portion configured to be disposed on a second side of a glass door opposite said first portion of said latch assembly;

said dead bolt assembly comprises:

a first portion configured to be disposed on a first side of a stationary door member; and a second portion configured to be disposed on a second side of a stationary door member opposite said first portion of said dead bolt assembly;

said first portion of said latch assembly and said first portion of said dead bolt assembly together form a first structure;

said second portion of said latch assembly and said second portion of said dead bolt assembly together form a second structure; and said first structure is configured to have substantially equal vertical and horizontal dimensions as said second structure to obscure a view of said second structure upon looking at said first structure from the first side of a glass door and a stationary door member, and to obscure a view of said first structure upon looking at said second structure from the second side of a glass door and a stationary door member.

14. The door locking assembly according to claim 13, wherein said means for operating said latch member to latch a glass door comprises:

a shaft configured to be rotated to operatively move said latch member;

said shaft is configured be disposed through a hole in a glass door to extend from both sides of the glass door;

a first extending portion connected to one end of said shaft and a second extending portion connected to the opposite end of said shaft;

each of said first and second extending portions extends a substantial distance out and away from said shaft and is configured to be grasped and moved by a user to rotate said shaft; and each of said first and second extending portions are substantially the same size and configured to be disposed such that a view of said first extending portion is substantially obscured upon looking at said second extending portion from one side of a glass panel, and such that a view of said second extending portion is substantially obscured upon looking at said first extending portion from an opposite side of a glass panel.

15. The door locking assembly according to claim 14, wherein said first and second extending portions each comprise handles;

each of said latch assembly and said dead bolt assembly comprises said protruding portion;

said protruding portion of said latch assembly is configured to protrude beyond a vertical edge of a glass door adjacent a stationary door member;

said protruding portion of said dead bolt assembly is configured to protrude beyond a vertical edge of a stationary door member adjacent a glass door;

said latch member is disposed in said protruding portion of said latch assembly; and said dead bolt is disposed in said protruding portion of said dead bolt assembly and configured to extend out of said protruding portion of said dead bolt assembly.

16. The door locking assembly according to claim 15, wherein:

said dead bolt assembly comprises a lock cylinder operatively connected to said dead bolt; and said lock cylinder is configured to be actuated to move said dead bolt into and out of said hole.

17. A glass door assembly comprising:

a glass side panel;

said glass side panel being attached and fixed to a building structure;

a movable glass door comprising a glass panel;

said movable glass door comprising hinges to pivotably mount said movable glass door on a building structure;

said movable glass door having an open position and a closed position;

said closed position being the position in which said glass panel of said movable glass door is aligned with said fixed glass side panel;

said open position being the position in which said movable glass panel of said movable glass door is pivoted away from and out of alignment with said fixed glass side panel;

a latching and locking arrangement being configured both to latch said movable glass door and to lock said movable glass door;

said latching and locking arrangement comprising a movable portion being mounted on said movable glass door and a fixed portion being mounted on said fixed glass side panel;

said door assembly having a first side and a second side opposite said first side;

said movable portion of said latching and locking arrangement comprising a first latch casing disposed on said first side of said door assembly;

said movable first latch casing comprising a latch mechanism having a latch bolt;

said fixed portion of said latching and locking arrangement comprising a second latch casing disposed on said first side of said door assembly;

said fixed second latch casing comprising an opening to receive said latch bolt of said movable first latch casing to hold said movable glass door in said closed position;

said movable portion of said latching and locking arrangement comprising a lever arrangement;

said lever arrangement comprising a first hand-operated lever handle disposed on said first side of said door assembly and a second hand-operated lever handle disposed on said second side of said door assembly;

each of said first and second hand-operated lever handles being substantially L-shaped and being configured to be manually operated by a user to move said latch bolt out of said opening to release said movable glass door from said fixed glass side panel to permit movement of said movable glass door into said open position;

said movable portion of said latching and locking arrangement further comprising a first lock casing disposed on said second side of said door assembly opposite said movable first latch casing;

said movable first lock casing comprising a dead bolt receptacle being configured to receive a dead bolt;

said fixed portion of said latching and locking arrangement further comprising a second lock casing disposed on said second side of said door assembly opposite said fixed second latch casing;

said fixed second lock casing comprising a dead bolt mechanism having a dead bolt;

said dead bolt being configured to be moved into said dead bolt receptacle of said movable first lock casing to lock said movable glass door upon said movable glass door being in said latched, closed position; and said fixed dead bolt mechanism comprising a lock cylinder configured to be actuated to move said dead bolt into and out of said dead bolt receptacle to lock and unlock said movable glass door.

18. The glass door assembly according to claim 17, wherein:

said movable first latch casing comprises a protruding portion;

said fixed second lock casing comprises a protruding portion; and each of said protruding portions are configured to stop the pivoting movement of a glass door.

19. The door locking assembly according to claim 18, wherein:

said movable first latch casing and said fixed second latch casing together form a first structure;

said movable second lock casing and said fixed first lock casing together form a second structure; and said first structure is configured to have substantially equal vertical and horizontal dimensions as said second structure to obscure a view of said second structure upon looking at said first structure from said first side of said door assembly, and to obscure a view of said first structure upon looking at said second structure from said second side of said door assembly.

20. The door locking assembly according to claim 19, wherein each of said lever handles are substantially the same size and configured to be disposed such that a view of said first lever handle is substantially obscured upon looking at said second lever handle from said second side of said door assembly, and such that a view of said second lever handle is substantially obscured upon looking at said first lever handle from said first side of said door assembly.

* * * * *

UNITED STATES PATENT AND TRADEMARK OFFICE

CERTIFICATE OF CORRECTION

PATENT NO. : 6,449,994 B1 
DATED : September 17, 2002
INVENTOR(S) : Ralf Kreyenborg It is certified that error appears in the above-identified patent and that said Letters Patent is hereby corrected as shown below:

Title page,
Item [56], References Cited, U.S. PATENT DOCUMENTS, before '* 11/1978', delete "4,125,022" and insert -- 4,126,022 --.

Signed and Sealed this

Fourth Day of February, 2003

JAMES E. ROGAN
*Director of the United States Patent and Trademark Office*